United States Patent [19]

Wagner et al.

[11] 4,079,220

[45] Mar. 14, 1978

[54] SNAP ACTION SWITCH

[75] Inventors: William D. Wagner; Clifford L. Smith, Jr., both of Franklin, Ind.

[73] Assignee: The Bendix Corporation, South Bend, Ind.

[21] Appl. No.: 665,367

[22] Filed: Mar. 10, 1976

[51] Int. Cl.[2] ..... H01H 3/12

[52] U.S. Cl. ..... 200/159 R; 200/76; 200/DIG. 29

[58] Field of Search ..... 200/159 R, 159 A, 159 B, 200/76, 77, 16 R, 16 C, 153 J, DIG. 29

[56] References Cited

U.S. PATENT DOCUMENTS

| | | | |
|---|---|---|---|
| 1,918,199 | 12/1931 | Ward | 200/159 R |
| 3,060,285 | 10/1962 | Steinbruner | 200/159 A |
| 3,137,774 | 6/1964 | Dow et al. | 200/159 R |
| 3,336,556 | 8/1967 | Henriksen | 200/16 C |

FOREIGN PATENT DOCUMENTS

| | | | |
|---|---|---|---|
| 1,055,089 | 4/1959 | Germany | 200/159 R |
| 727,487 | 4/1955 | United Kingdom | 200/159 |

*Primary Examiner*—Samuel W. Engle
*Assistant Examiner*—Ralph Palo
*Attorney, Agent, or Firm*—Ken C. Decker; William N. Antonis

[57] ABSTRACT

A snap action electrical switch is disclosed which includes an actuating plunger slidably mounted within a switch housing, which carries two pairs of circumferentially spaced terminals. The plunger carries two sets of contacts which correspond to respective pairs of the terminals. Each set of the contacts includes a pair of spheres slidingly mounted within a transverse bore provided within the plunger and a spring which yieldably urges the spheres toward opposite ends of the transverse bore. An insulating member is disposed between the terminals and the plungers. One pair of apertures, provided in the insulating member, register with one of the transverse bores when the plunger is in one position and another pair of apertures register with the other transverse bore when the plunger is moved to another position. Consequently, when the transverse bores are in registry with the respective apertures, the spring yieldably urges the corresponding contacts into engagement with the terminals, thereby completing an electrical circuit between the terminals through the corresponding contacts and their corresponding spring.

4 Claims, 4 Drawing Figures

SNAP ACTION SWITCH

BACKGROUND OF THE INVENTION

This invention relates to a snap action electrical switch.

A snap action switch is a switch in which the speed of the contacts during actuation of the switch is relatively independent of the speed of the actuating mechanism. In switches of this type, it is desirable to minimize the opening and closing times of the switch, to prevent damage to the electrical equipment which the switch controls. It is also desirable in switches of this type to minimize the size of the switch, since these types of switches are often used in aircraft or other installations in which space constraints severely limit the maximum size of the switching mechanism. It is also desirable to provide a switch with reversible contact arrangements, so that the same switch, with minor modifications, may be used as a two-circuit switch; as a single pole, double-throw switch; or as a single pole normally opened or normally closed switch.

SUMMARY OF THE INVENTION

An important object of our invention is to provide a snap action switch in which the opening and closing times of the switch are minimized.

Another important object of our invention is to minimize the size of a snap action switch.

A still further important object of our invention is to provide a snap action switch in which the same basic switch assembly, with relatively minor modifications, may be used in a variety of configurations.

DETAILED DESCRIPTION

Figure 1:
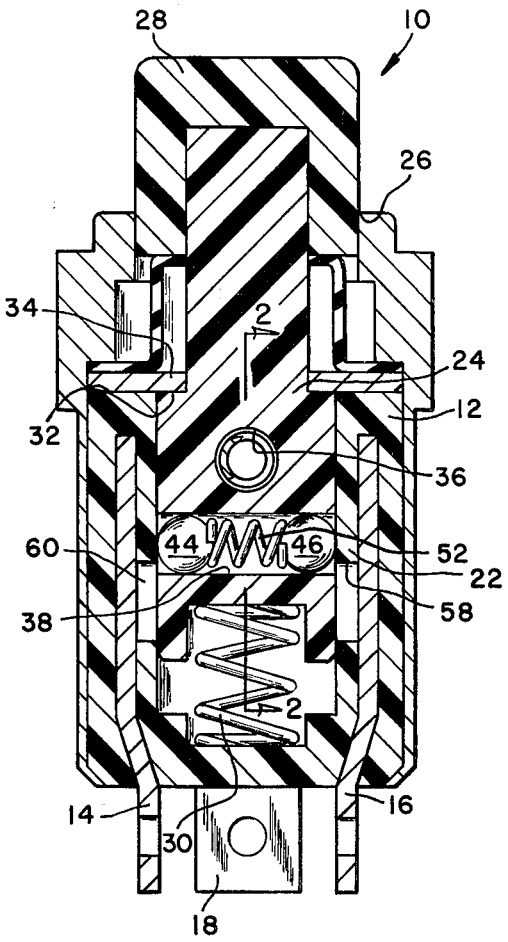
FIG. 1 is a longitudinal cross-sectional view of a switch assembly made pursuant to the teachings of our present invention.

Referring now to the drawings, a snap action switch generally indicated by the numeral 10 includes a housing 12 which carries a first pair of terminals 14, 16, and a second pair of terminals 18, 20. The terminals 18, 20 are circumferentially spaced around the housing from the first set of terminals 14, 16. The housing 12 further includes an insulating member 22, which slidingly receives an actuating mechanism or plunger 24. The plunger 24 extends from the open end 26 of the housing 12, and terminates in a button 28 for actuation by the switch operator. A spring 30 yieldably urges the plunger 24 to the unactuated position illustrated in FIG. 1 in which a shoulder 32 on the plunger 24 engages a circumferentially extending stop member 34 carried by the housing 12.

Figure 3:
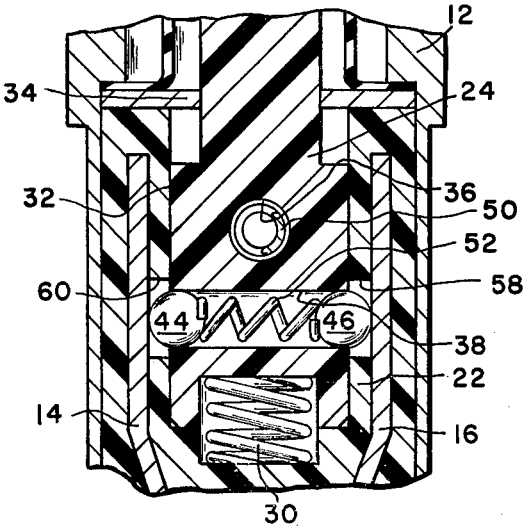
FIG. 3 is a fragmentary view similar to FIG. 1, but illustrating the switch assembly in its actuated condition.
Figure 4:
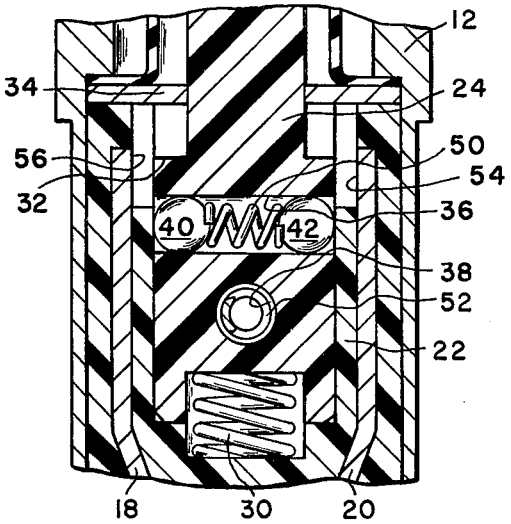
FIG. 4 is a view similar to FIG. 2, but illustrating the switch in its actuated condition.

The plunger 24 is provided with a pair of axially spaced, circumferentially offset, transversely extending bores 36 and 38. Corresponding pairs of spherical contacts 40, 42 and 44, 46, are disposed in the bores 36 and 38, respectively. Springs 50, 52 are also disposed in the bores 36 and 38 between the spherical contact members located in the bores 36 and 38 and yieldably urge the spherical contact member towards opposite ends of the corresponding bores. The insulating member 22 is provided with diametrically opposed apertures 54, 56 which expose a portion of the contacts 18, 20 and which register with the end of the bore 36 when the switch 10 is in the unactuated condition illustrated in FIGS. 1 and 2. Insulating member 22 is further provided with diametrically opposed apertures 58, 60 which expose a portion of the terminals 14, 16, and which register with opposite ends of the bore 38 when the switch is in its actuated condition as illustrated in FIGS. 3 and 4. It will be noted that the diameter of the spheres 40, 42, 44, and 46 is larger than the thickness of the insulating member 22. Consequently, when the bores 36, 38 are brought into registry with their corresponding apertures 56, 54 and 58, 60 the spheres 46 can engage the terminals 14, 16 while the greater portion of the spheres remain in their respective bores.

MODE OF OPERATION

Figure 2:
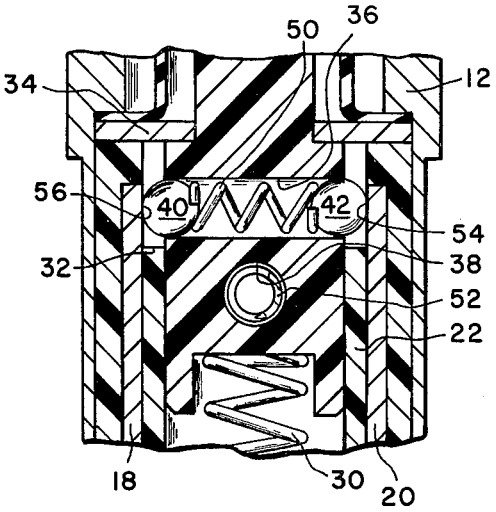
FIG. 2 is a fragmentary, cross-sectional view taken substantially along lines 2—2 of FIG. 1.

As discussed hereinabove, FIGS. 1 and 2 illustrate the switch 10 in its unactuated or released position. In this condition, the bore 36 is in registry with the apertures 54, 56 and the spring 50 urges the spherical contact members 40, 42 into engagement with their corresponding terminals 18 and 20. Since the contact members 40, 42 and the spring 50 are all made of electrically conductive material, an electrically conducting path is established between the terminals 18 and 20. However, as best illustrated in FIG. 1, while the bore 36 is in registry with the apertures 54 and 56 when the switch is released, the bore 38 is then out of registry with its corresponding apertures 58, 60. Consequently, the spring 52 can only urge the contacts 44, 46 against the insulating member 22. Therefore, an open circuit exists between the contacts 14, 16. When the button 28 is pushed, the plunger 24 is urged downwardly, viewing the Figures, thereby forcing the bore 36 out of registry with the apertures 54 and 56. Since the greater portion of the spherical contact members 40 and 42 are located within the bore 36 even when the bore is in registry with the apertures 54 and 56, the spheres 40, 42 will be forced away from the contacts 18, 20 upon engagement of the latter with the lower edge of the aperture so that the spheres 40, 42 are wholly within the bore 36. Consequently, the electrical circuit between the terminals 18 and 20 will be broken. At the same time, as the plunger 24 is moved downwardly, the bore 38, as is best illustrated in FIG. 3, will be brought into registry with the apertures 58, 60 permitting the spring 52 to urge the spherical contact members 44, and 46 outwardly with respect to the bore 38, and into the apertures 58, 60. When this occurs, the spherical contact members 44 and 46 establish contact with the terminals 14 and 16, thereby establishing an electrically conducting circuit between the terminals 14 and 16 through the spherical contact members 44, 46 and the spring 52. When the button 28 is released, the spring 30 urges the plunger 24 upwardly viewing the Figures, into the unactuated or released position illustrated in the FIGS. 1 and 2.

It will be noted that, with minor modifications to the switch 10, the latter can be adapted to several different configurations. For example, in the configuration illustrated in the drawings, the switch is used as a two-circuit switch, with one circuit closed while the other circuit is open. If necessary, the switch 10 can be converted to a single pole, normally open switch by merely cutting off the portion of the terminals 18 and 20 which project out of the lower edge of the housing. Similarly, the switch 10 can be converted into a single pole, normally closed switch by cutting off the portion to the terminals 14 and 16 which project from the lower portion of the housing 22. The switch may also be used as a single pole, double-throw switch by adding a jumper wire between appropriate pairs of terminals, such as between the terminals 16 and 18. Furthermore, the switch may be designed as a three-circuit switch by adding a third pair of terminals and a third bore within the plunger 24.

We claim:

1. In a switch, an annular housing, a pair of diametrically opposite terminals carried by the wall of said housing and extending parallel to the axis of the latter, a plunger slidably mounted in said housing, the inner circumferential surface of said housing being defined by an electrically insulative member and slidably receiving said plunger, said plunger being slidable within said housing between a pair of predetermined positions, said plunger defining a transverse bore therewithin, a pair of contact members slidably mounted in said transverse bore, resilient means within said bore between said contact members yieldably urging said contact members toward opposite ends of the transverse bore and into engagement with said electrically insulative member when the plunger is disposed in one of said positions and as the plunger is moved from said one position to the other position, a pair of diametrically opposite apertures in said insulative member exposing portions of said contacts, the length of said apertures along the axis of the bore being small in comparison with the length of said housing so that said contact members engage said insulative member when the plunger is disposed in said one position and as the plunger is moved between said positions but snap through said apertures by the force of said resilient means when the plunger is moved into the other position defined by the transverse bore being brought into registry with the apertures, said contact members and said resilient means being electrically conductive to define a circuit path between said terminals when the plunger is disposed in said other position.

2. The invention of claim 1:

and a second transverse bore in said plunger offset circumferentially and axially from the other transverse bore, a second pair of terminals carried by said housing offset circumferentially from the other pair of terminals, a second pair of apertures in said electrically insulative material exposing said second pair of terminals when the plunger is disposed in said one position, and a second pair of contact members in said second transverse bore, second resilient means urging said second pair of contact members toward opposite ends of the second transverse bore and through said second pair of apertures into engagement with said second pair of terminals when the plunger is disposed in the one position, said second resilient means urging said second pair of contact members into engagement with said electrically insulative member when the plunger is disposed in the other position and when the plunger is moved between said positions.

3. The invention of claim 1; and yieldable means yieldably urging said plunger toward one of said position.

4. The invention of claim 1:

said members being spheres, the diameter of said spheres being greater than the thickness of said electrically insulative means.

* * * * *